US007040830B2

(12) United States Patent
Kliegman et al.

(10) Patent No.: US 7,040,830 B2
(45) Date of Patent: May 9, 2006

(54) SOAP DISPENSING APPARATUS

(75) Inventors: Adriana Kliegman, New York, NY (US); Alec Holly Drummond, Brooklyn, NY (US); Steven Dibdin, Brooklyn, NY (US); Wilfrido Loor, Brooklyn, NY (US); Goeran Jerstroem, New York, NY (US); John Thomas Jacobsen, New Bedford, MA (US)

(73) Assignee: Helen of Troy Limited, Bridgetown (BB)

( * ) Notice: Subject to any disclaimer, the term of this patent is extended or adjusted under 35 U.S.C. 154(b) by 80 days.

(21) Appl. No.: 10/673,006

(22) Filed: Sep. 26, 2003

(65) Prior Publication Data

US 2005/0069375 A1 Mar. 31, 2005

(51) Int. Cl.

| | |
|---|---|
| ***A46B 11/00*** | (2006.01) |
| ***A46B 11/02*** | (2006.01) |
| ***A46B 11/04*** | (2006.01) |
| ***B43K 5/00*** | (2006.01) |

(52) U.S. Cl. ..... 401/290; 401/187; 401/206; 401/278; 401/279

(58) Field of Classification Search ..... 401/6, 401/188 R, 205, 206, 207, 270, 278, 279, 401/187, 290

See application file for complete search history.

(56) References Cited

U.S. PATENT DOCUMENTS

| | | | | |
|---|---|---|---|---|
| 838,241 | A | | 12/1906 | Conners |
| 1,060,046 | A | | 4/1913 | Wells |
| 1,099,209 | A | | 6/1914 | Segal et al. |
| 1,293,071 | A | | 2/1919 | Fopiano |
| 1,329,944 | A | | 2/1920 | Williams |
| 1,470,903 | A | | 10/1923 | Ahlering |
| 2,795,000 | A | | 6/1957 | Lomholdt |
| 2,823,401 | A | | 2/1958 | Higgins |
| 2,829,393 | A | | 4/1958 | Turcotte |
| 2,864,367 | A | | 12/1958 | Mende |
| 3,889,640 | A | | 6/1975 | Restall |
| 4,826,340 | A | | 5/1989 | Rothweiler et al. |
| 4,861,180 | A | | 8/1989 | Adams |
| 4,955,746 | A | | 9/1990 | Craigmile |
| 4,961,662 | A | * | 10/1990 | Chow et al. ..... 401/42 |
| 4,991,745 | A | | 2/1991 | Brown |
| 5,158,383 | A | | 10/1992 | Glover et al. |
| 5,211,494 | A | | 5/1993 | Baijnath |
| 5,213,236 | A | | 5/1993 | Brown et al. |
| 5,339,995 | A | | 8/1994 | Brown et al. |
| 5,346,324 | A | | 9/1994 | Kuo |
| 5,377,877 | A | | 1/1995 | Brown et al. |
| 5,409,144 | A | | 4/1995 | Brown |

(Continued)

OTHER PUBLICATIONS

3M Scotch-Brite Products—Handle Products website pages dated Jul. 23, 2003 (4 pages).

(Continued)

*Primary Examiner*—David J. Walczak
(74) *Attorney, Agent, or Firm*—Seyfarth Shaw LLP

(57) ABSTRACT

A fluid-dispensing kitchen apparatus has a body including a fluid reservoir and a handle, the reservoir being closed by an end plate which is welded to the body and is, in turn, latched to a cleaning medium block. An embodiment has a resilient tab on the block engaging an edge of the housing plate. Aligned holes through the plate and the block which provide communication between the reservoir and the plate is openable and closeable by a valve actuated by an increase in pressure provided by depressing a resilient button. In an embodiment, the resilient button includes a bias member to return the button to its rest position.

13 Claims, 5 Drawing Sheets

U.S. PATENT DOCUMENTS 5,439,143 A 8/1995 Brown et al.
5,827,001 A 10/1998 Taghavi-Khanghah
5,851,077 A 12/1998 Trejo
5,885,019 A 3/1999 Stear
5,890,829 A 4/1999 Hesse
6,009,887 A 1/2000 Hertel
6,017,162 A 1/2000 Call
6,036,391 A * 3/2000 Holliday et al. ..... 401/188 R
6,129,469 A 10/2000 Messer et al.
6,171,004 B1 1/2001 Derhammer
6,210,064 B1 4/2001 White et al.
6,227,740 B1 5/2001 Stear et al.
6,247,862 B1 6/2001 Garza
6,250,833 B1 6/2001 Perry et al.
6,261,014 B1 7/2001 Altobellis et al.
6,412,997 B1 7/2002 Berke et al.
6,425,701 B1 * 7/2002 Jacobs ..... 401/6
6,530,707 B1 3/2003 Byrne et al.
6,536,970 B1 3/2003 Hauser et al.
6,540,117 B1 4/2003 Powling
6,543,950 B1 4/2003 Huang
6,543,954 B1 4/2003 Owings
6,550,996 B1 4/2003 Rayfield
6,817,801 B1 * 11/2004 Colburn et al. ..... 401/205
2003/0111555 A1 6/2003 Song

OTHER PUBLICATIONS

LMS Custom Products—website paged dated Jul. 22, 2003 (6 pages).

* cited by examiner

SOAP DISPENSING APPARATUS

The present invention relates to fluid-dispensing implements or utensils, and in particular to household cleaning implements or utensils, such as brushes or sponges and the like. The invention has particular application to a kitchen apparatus or wand which is capable of dispensing liquid soap or detergent.

BACKGROUND OF THE INVENTION

Many fluid-dispensing apparatuses have heretofore been provided. Such apparatuses typically include a fluid reservoir, a closeable opening for filling the reservoir, and a manually actuated valve mechanism for dispensing fluid from the reservoir to the area of the apparatus bristles or sponge. However, such prior apparatuses have typically been characterized by either a relatively complex or expensive-to-manufacture construction or have valve actuating mechanisms which are inefficient.

SUMMARY OF THE INVENTION

It is a general object of the invention to provide an improved fluid-dispensing implement which avoids the disadvantages of prior such implements while affording additional structural and operating advantages.

An important feature of the invention is the provision of an implement of the type set forth, which combines the functions of valve actuation and elevation of a button, returning the button to its at rest position.

Another feature of the invention is the provision of an implement of the type set forth which affords a unique latching engagement between a work-engaging medium holder and an implement housing.

Another feature of the invention is the provision of an implement of the type set forth, which provides a resilient button with a unique bias mechanism.

Still another feature of the invention is the provision of an implement of the type set forth, which is of relatively simple and economical construction.

Certain ones of these and other features of the invention may be attained by providing a fluid-dispensing implement comprising: a body defining a fluid reservoir therein, a handle carried by the body, a work-engaging medium carried by the body, a valve assembly carried by the body for providing communication between the reservoir and the medium, the body having a flexible and resilient hollow button carried by the body for movement between rest and depressed positions, the button being manually deflectable to increase pressure in the reservoir and actuate the valve.

Certain ones of these and other features of the invention may also be attained by providing a fluid-dispensing implement comprising: a housing defining a fluid reservoir therein, a wedge shaped projection on the housing, a holder having a wedge-shaped recess and a latch lever disposed adjacent the recess and the latch lever extending along a bottom of the recess, the latch lever for latching engagement with the projection for securely mounting the holder on the housing when the projection is mateably received in the recess, a work-engaging medium carried by the holder and a valve carried by the housing and cooperating with the holder to provide communication between the reservoir and the medium.

Other features of the invention may be attained by providing the medium on a holder which is latchable to an implement housing.

Still further features of the invention may be afforded by providing an implement of the type set forth wherein the valve assembly includes a button having a bias member.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 2 is an exploded perspective view of the apparatus of FIG. 1;

DETAILED DESCRIPTION

Figure 1:
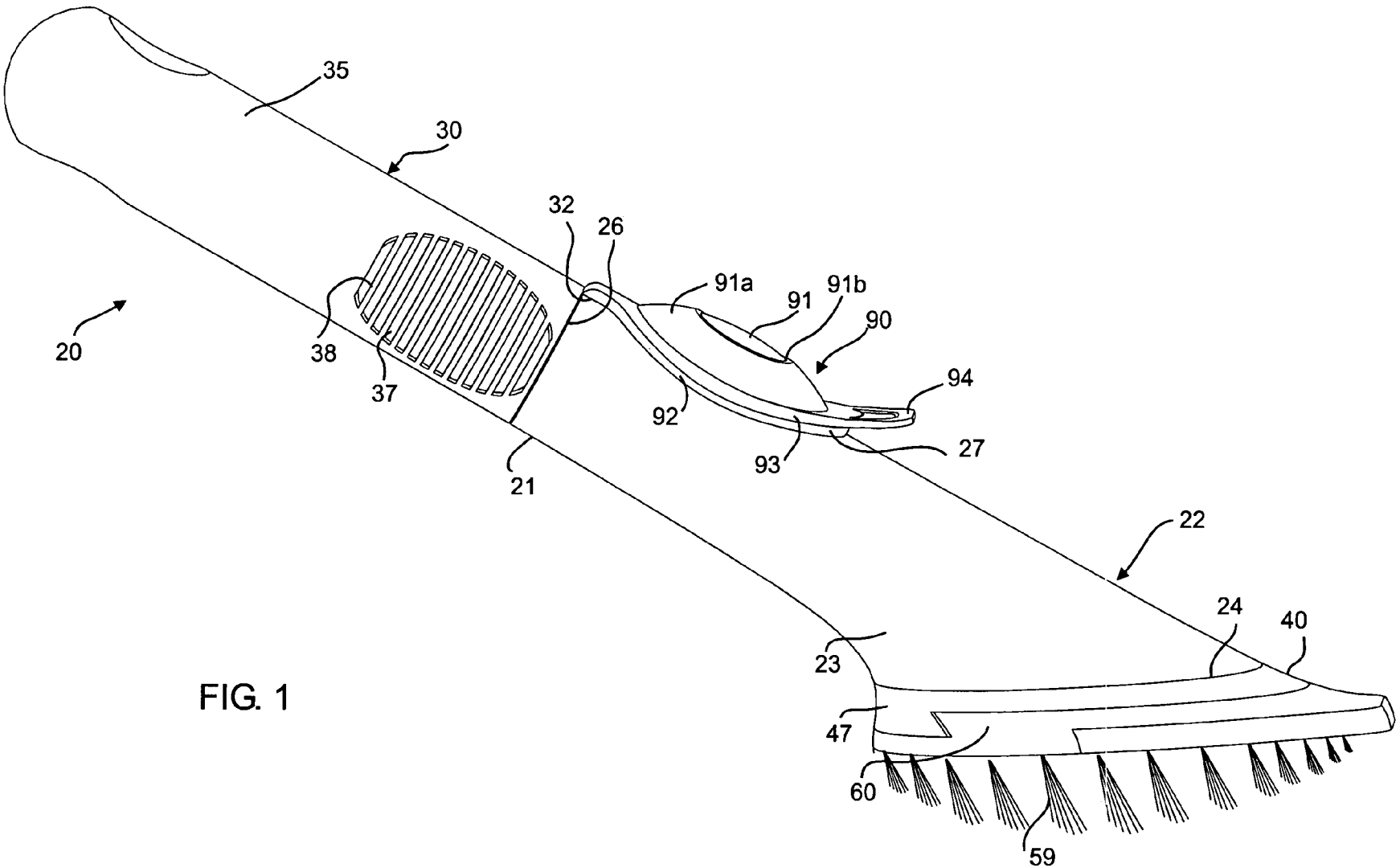
FIG. 1 is a side elevational view of a kitchen apparatus in accordance with the present invention.

Referring to FIGS. 1 and 2, there is illustrated a fluid-dispensing implement in the nature of a kitchen apparatus 20, constructed in accordance with and embodying the features of the present invention. The apparatus 20 has a handle or housing 21, which includes a body 22 with a hollow, tubular front portion 23 closed by an end plate 40, for cooperation therewith to define a fluid reservoir 10. The hollow tubular front portion 23 flares outwardly, forwardly terminating in a front end 24. In an embodiment, a flange 25 may be provided which can be used as a scraper or the like (See FIGS. 4 and 5). Opposite the tubular front portion 23 is an end wall 26 that is provided at its upper side with an oval aperture 27, adjacent to the end wall 26 for receiving a button 90 (described in detail below). The oval aperture 27 and body 22 is constructed according to that disclosed in U.S. Pat. No. 6,250,833 incorporated herein by reference.

Integral with the end wall 26 and projecting rearwardly therefrom is an elongated handle 30, generally oval in transverse cross section and provided with pairs of longitudinal slots 31 along the upper and lower sides thereof. Also formed in the upper side of the handle 30 adjacent to the end wall 26 is a rectangular recess 32. The handle 30 is covered by a grip sleeve 35 formed of a suitable frictional and cushioning material such as santoprene. The sleeve 35 has a closed end which extends beyond the distal end of the handle 30 and has a through hole 36 therein to facilitate hanging the apparatus 20. The slots 31 in the handle 30 reduce the surface area thereof to facilitate sliding the sleeve 35 onto the handle 30, the sleeve 35 being secured in place by any suitable means. Formed in the opposite sides of the sleeve 35 are grip sites defined by generally saddle-shaped recesses 37, each recess 37 being provided with a plurality of laterally outwardly projecting, flexible and resilient ribs 38 to facilitate gripping by a user's thumb and forefinger. The grip sleeve 35 may be generally of the type disclosed in U.S. Pat. No. Re. 34,194, the disclosure of which is incorporated herein by reference.

The end plate 40 is preferably of unitary, one-piece construction and includes an oval base wall 41 having a peripheral raised rim 42 of substantially the same size and shape as the wide end 24 of the body 22. The base wall 41 has a large, generally wedge-shaped projection in one end thereof which provides a coupling structure 43. The coupling structure 43 has a flat bottom wall 44 parallel with the base wall 41 and joined thereto by a pair of converging side walls 45*a*, 45*b*, a narrow end wall 46 and a wide end wall 47 which is arcuate in shape and generally follows the contour of the base wall oval rim 42. Formed generally centrally through the bottom wall 44 is an aperture 48 with an end disposed at the upper surface of the bottom wall 44. Each of the side and end walls 45–47 has an inner surface which is substantially perpendicular to the bottom wall 44. However, the converging side walls 45 have outer surfaces which slope downwardly and laterally outwardly. Thus, it will be appreciated that the outer surface of the narrow end wall 46 is substantially trapezoidal in shape. In an alternate embodiment, the coupling structure may be formed directly on the housing.

In an embodiment, the apparatus 20 has a plurality of bristles 59 (FIG. 2), which are preferably arranged in groups respectively mounted in sockets in a holder or bristle block 60, all in a well known manner. The bristle block 60 has an oval shape sized for mating with the end plate 40. The bristle block 60 has a coupling structure including a generally wedge-shaped recess 61 formed in the upper surface thereof sized for mating with the coupling structure 43 of the end plate 40, and extending from the rear end of the bristle block 60 longitudinally forwardly to a narrow end adjacent to the forward end of the bristle block 60. The recess 61 has a flat bottom surface 62 in which is formed an aperture 63, which extends to the bottom of the bristle block 60.

Figure 5:
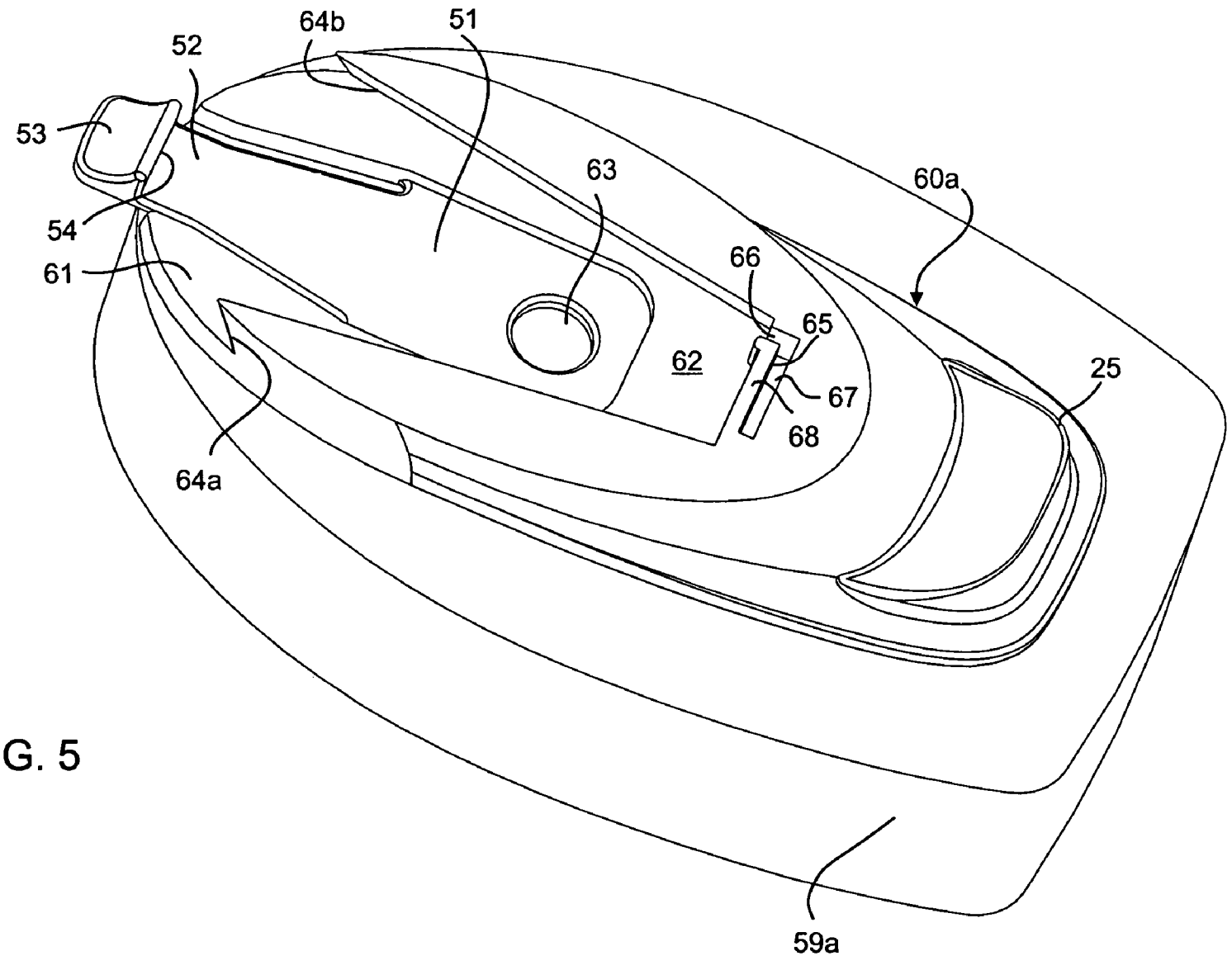
FIG. 5 is a perspective view of a sponge block of the apparatus of FIG. 3.

In an alternate embodiment, the bristle block 60 may be provided for mounting other cleaning media such as pads or a sponge. For example, a sponge block is depicted in FIG. 5. The block may have a similar structure to the bristle block 60. In an embodiment, the block 60*a* (as shown in FIG. 5) includes the recess 61 having converging, undercut side surfaces 64*a*, 64*b* which slope downwardly and laterally outwardly. Formed in the side surfaces 64*a*, 64*b* rearwardly of the aperture 63 is a generally L-shaped notch 65, having a relatively short leg 66 which communicates with the recess 61 and a long leg 67 to define therebetween a finger 68. The finger 68 is spaced a slight distance above the bottom surface 62 so as to define a thin, flexible and resilient member which can move laterally into the long leg 67 of the adjacent notch 65.

In an embodiment, the coupling structure of the block 60 further includes the recess 61 having a latch arm 51 formed parallel to the bottom surface 62. The latch arm 51 includes a latch lever 52 having a tab 53 having a latch surface 54 extending generally perpendicular from the latch lever 52. In an embodiment, the tab 53 has a curved surface to allow for a user's finger or thumb to be comfortably placed thereon to actuate the lever 52. In an alternate embodiment, the coupling structure of the block may include a projection and the coupling structure of the end plate may be a recess. In a further alternate embodiment, the first and second coupling structures may have various intermateable shapes.

In assembly, the wedge-shaped coupling structure 43 of the end plate 40 is slid longitudinally into the wedge-shaped recess 61 of the bristle block 60*a*, so that the sloping side surfaces of the end plate 40 provide a dovetail fit with the undercut side surfaces 64 of the block 60, 60*a*. As the end plate 40 approaches its fully inserted position in the recess 61, the end wall 46 is brought into engagement with the finger 68 which acts as a living spring. The finger 68 is deflected laterally inward to allow for the coupling structure 43 of the end plate 40 to mate snugly within recess 61 and firmly latch the end plate 40 and the bristle block 60 together via latching engagement of the latch tab 53 against end wall 47, as depicted in the latched configuration illustrated in FIG. 4. The spring finger 68 also biases against the projecting coupling structure 43 in order to help eject the projection 43 from recess 61 when the latch lever 52 is depressed. In the mated configuration, as can best be seen in FIG. 4, the apertures 48 and 63 are coaxially aligned with each other, and the outer peripheral surfaces of the end plate 40 and the bristle block 60 are substantially continuous with each other. It is apparent that the latch lever 52 depicted in FIGS. 4 and 5, may also be provided on the bristle block 60 of FIGS. 1 and 2.

Figure 4:
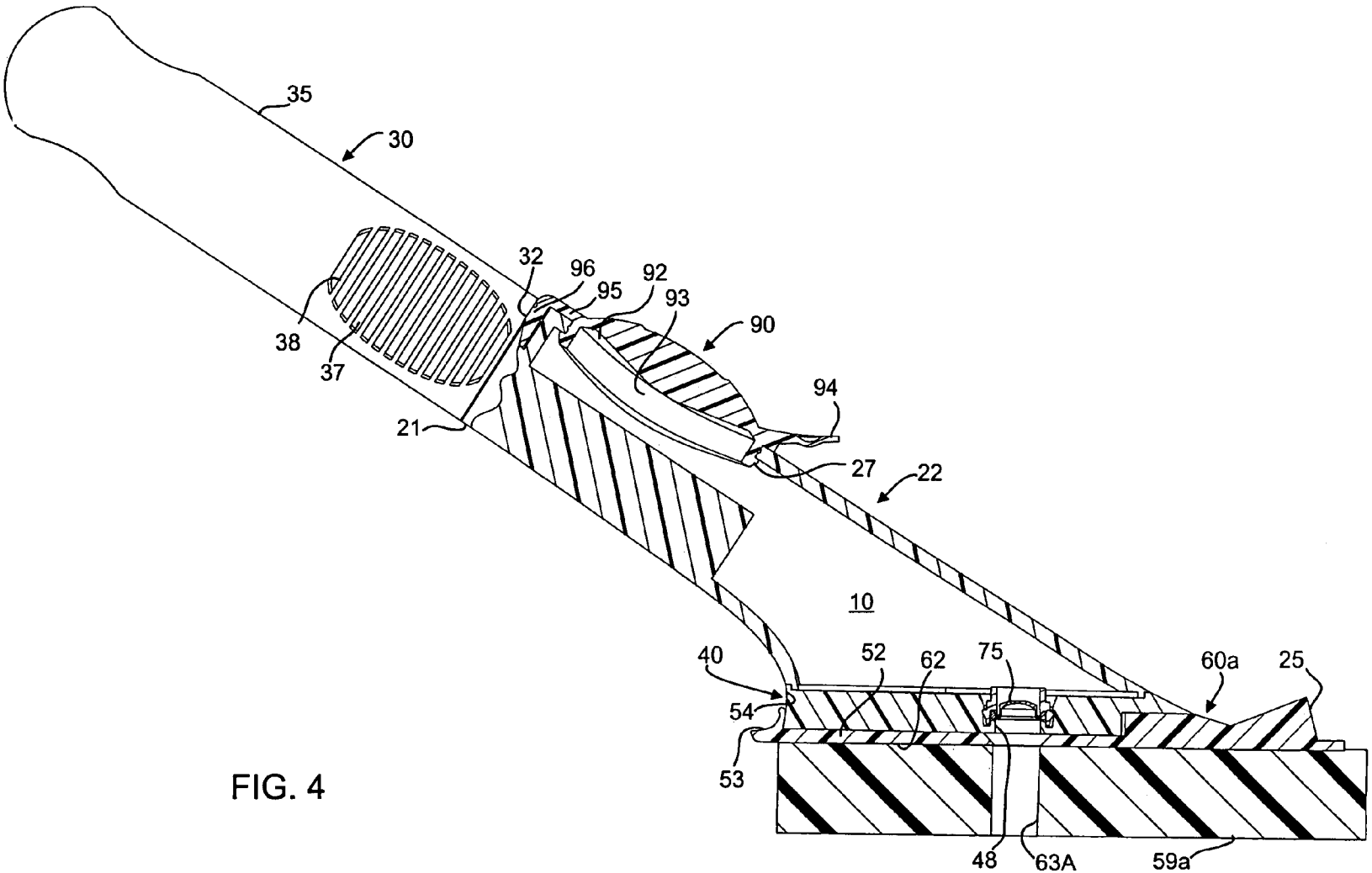
FIG. 4 is a side elevation, partially sectioned view of an alternate embodiment of a kitchen apparatus in accordance with the present invention.

Referring now in particular to FIGS. 2 and 4, the apparatus 20 includes a valve assembly, generally designated by the numeral 70 mounted on the end plate 40. The valve assembly 70 includes a cylindrical retaining ring 71 having an annular flange 72 and a bore 73. The bore 73 receives a valve 75 therein. For example, a valve 75 such as disclosed in U.S. Pat. Nos. 5,439,143, 5,409,144, 5,377,877, 5,339,995, 5,213,236, 5,033,655, 4,991,745 that are incorporated herein by reference may be used in the present invention. Other known valve assemblies may also be mounted in the end plate 40.

Referring to FIGS. 1–4, the apparatus 20 also includes a button 90 having a flexible and resilient member or dome 91 integral along its peripheral edge with a substantially cylindrical side wall 92 which has an annular rim 93 formed in the outer surface thereof which projects laterally outwardly from the upper end of the side wall 92 adjacent to the dome 91. In an embodiment, the button 90 includes an annular groove 91*b* dividing the dome 91 from a skirt portion 91*a*. The groove 91*b* provides for a visual and textural indication for aiding a user in locating his/her finger or thumb at the center of the button 90 in order to maximize the deflection of the button 90 upon assertion of manual force thereon. In an embodiment, the dome 91 and skirt 91*a* are integrally formed of a resilient and flexible material so that the entire button 90 may be deflected. In an alternate embodiment, the skirt portion 91*a* may be formed of a harder, less resilient, less flexible material than the dome 91; so that in a first stage of depression, the flexible dome 91 deflects and the skirt portion 91*a* remains in its rest position. A second stage of depression (upon exertion of additional force by a user's finger or thumb) provides for the skirt 91*a* to deflect and snap down into a depressed position causing a high speed pressure wave to be dispersed through the reservoir 10.

In an embodiment, the dome 91 is integral at its rear end with a flexible and resilient hinge 95 or tether. The hinge 95 has a leg 96 which extends rearwardly and is received in recess 32 in the handle 30. It will be appreciated that when the grip sleeve 35 is fitted in place over the handle 30 it covers the hinge leg 96 and abuts the hinge 95 for securely attaching the hinge 95 to the handle 30.

Figure 2A:
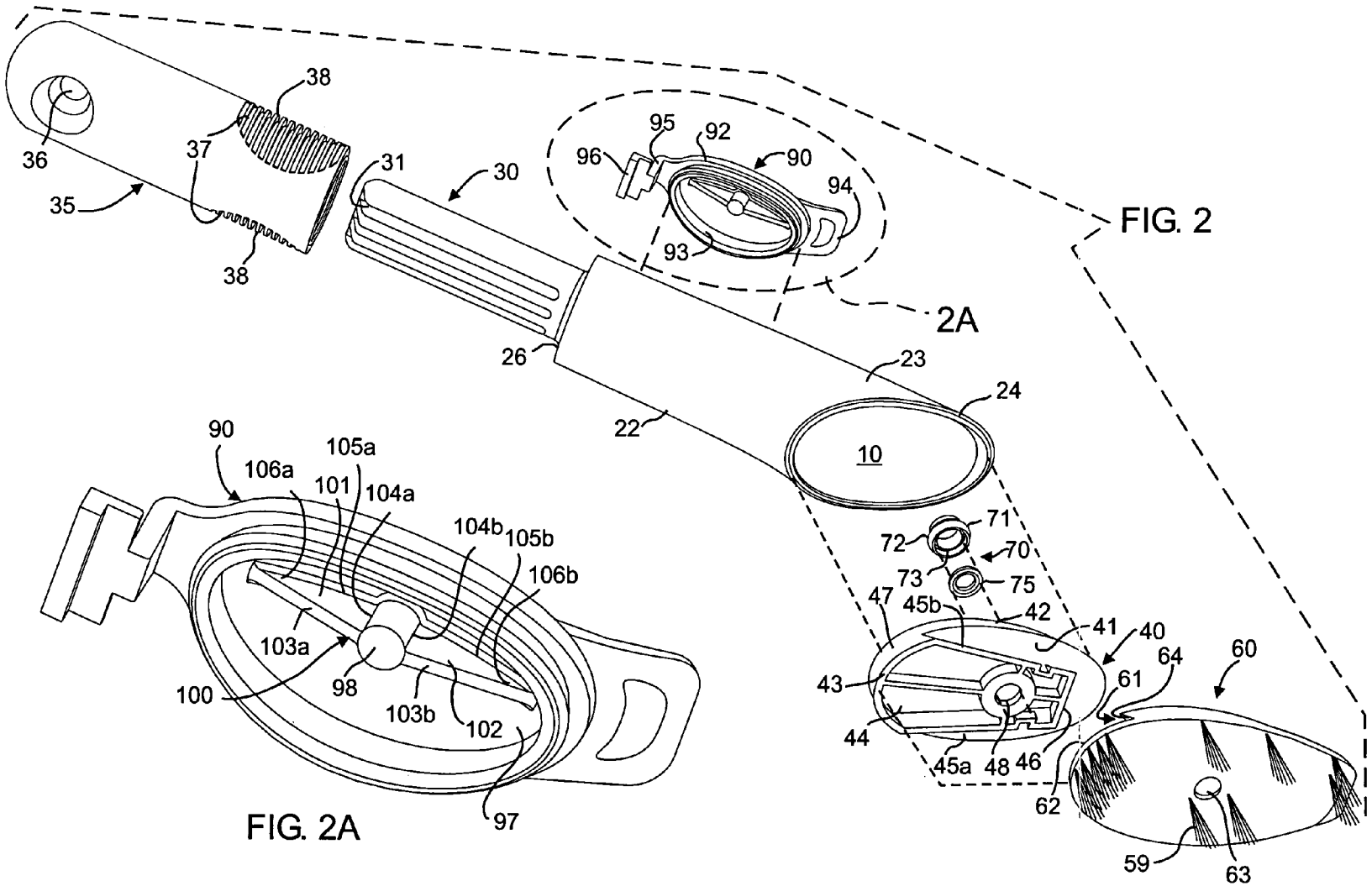
FIG. 2A is an enlarged, fragmentary, perspective view of the button of FIG. 2.

The button 90 includes an interior surface 97 that forms the dome 91. Protruding from the interior surface 97 at its center point is a nipple 98. A bias member 100 is disposed in the button 90. In an embodiment, the bias member 100 may include arms or ribs 101, 102 that extend from the sides of the nipple 98 bilaterally sectioning the interior 97. The ribs 101, 102 are transverse to the interior surface 97 and act to bias the dome 91 of the button 90 to return it to its rest position (as shown in FIG. 2A) after being depressed. In an embodiment, the ribs 101, 102 are generally triangular shaped and have sides including a free edge 103*a*, 103*b*, a base 104*a*, 104*b* and a dome edge 105*a*, 105*b* forming generally an isosceles triangle. The free edge 103*a*, 103*b* is approximately equal in length to the dome edge 105*a*, 105*b*. A vertex 106*a*, 106*b*, in an embodiment, is generally less than 30°. By forming a rib 101, 102 having such a sharp vertex and relatively long legs 103*a*, 103*b*, 105*a*, 105*b*, (in comparison to the base 104*a*, 104*b*), the bias member 100 can deflect inward and is able to return the dome 91 to its rest position. The geometry of the bias member 100 is also important with respect to the height and width of the nipple 98 and also the width of the ribs (defined by free edge 103*a*, 103*b*). In an embodiment, the nipple 98 has a height of approximately 8.7 mm and a width of approximately 5.0 mm. In an embodiment, the rib 101, 102 has a width of approximately 1.5 mm. In an embodiment the bias member 100 is integrally formed with the rest of the button 90 of a polymer such as Tresfin. In other embodiments alternate materials may be used such as a rubber material.

Figure 3:
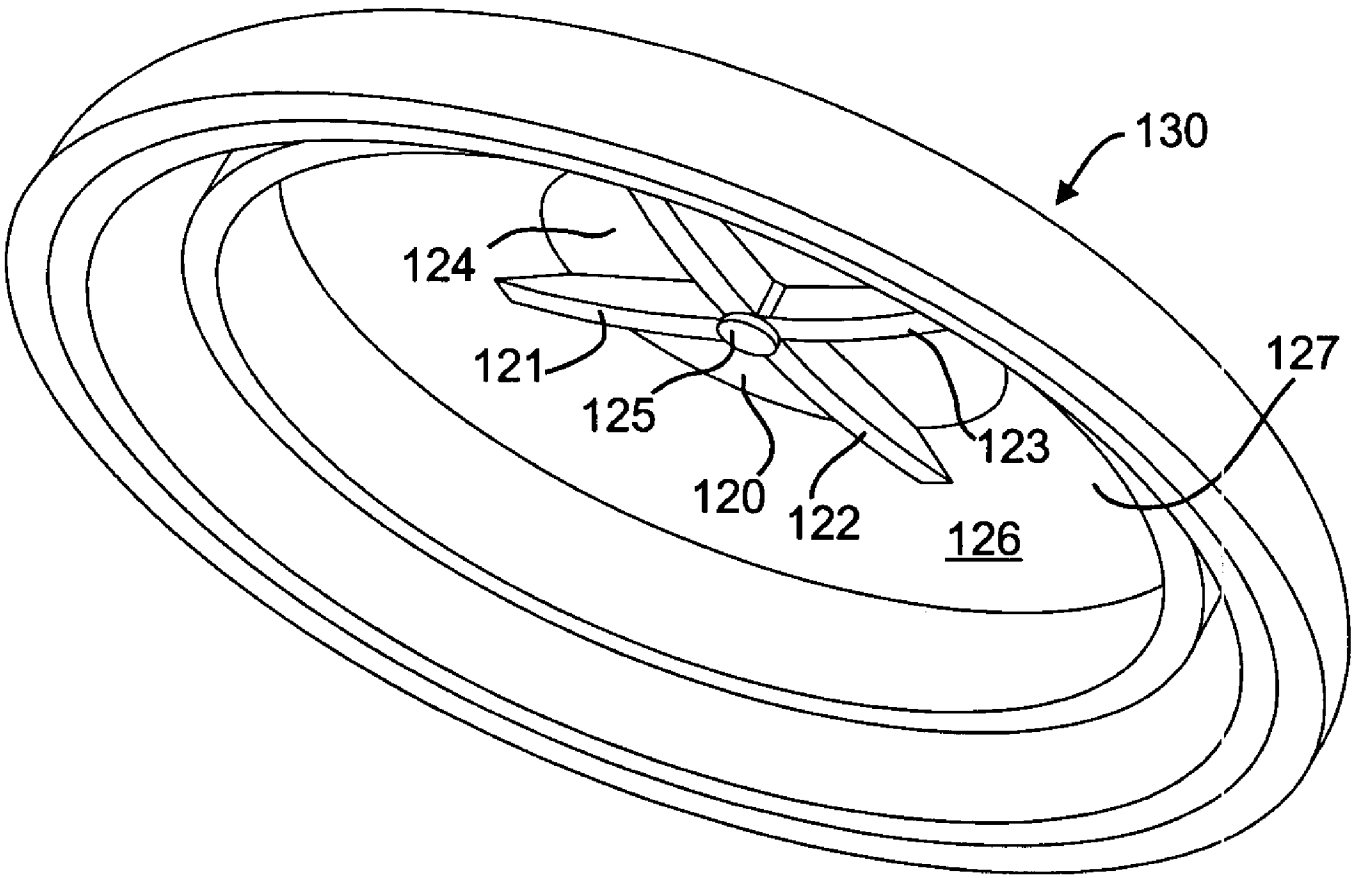
FIG. 3 is an enlarged perspective view of an alternate embodiment of a button.

It is to be understood that a bias member 100 having other geometries and formed of other materials may be provided. For example, a coil spring of metal or polymer may be disposed within the interior of the button 90. Other bias members such as spirals, bellows, L-shape or U-shape members may be provided. Further, by molding the button 90 so that protrusions or recesses are formed in the interior wall, for example, having a spiral shape, ring shape or other shapes, the button is provided with a bias feature. As well, FIG. 3 depicts an alternate embodiment of a bias member 120 having four arms 121, 122, 123, 124, extending from center nipple 125. The nipple 125 and arms 121, 122, 123, 124 in an embodiment, are integrally molded on the interior surface 126 of the dome 127 of the button 130.

In an alternate embodiment, the arms 121, 122, 123, 124 may be attached to the interior surface adjacent the nipple 125 and separated and free at each terminal end. The arms 121, 122, 123, 124 are deflectable and allow the dome to be depressed, but bias in order to return the dome to its rest position (shown in FIG. 3). It is to be understood that the button 130 may be insertable in the oval aperture 27 (FIGS. 1 and 4). In an alternate embodiment, the button 130 may have an annular rim and a hinge 95 at one end and a tab 94 at the opposite end, as described above for mounting the button 130 to the housing 21 of the apparatus 20. Likewise, the button 90 of FIGS. 1–2A, in an alternate embodiment may be provided without a hinge 95 or tab 94.

It will be appreciated that, in use, the button 90 depicted in FIGS. 1–2A is pivotally movable about the hinge 95 between an upstanding position opening the aperture 27 to permit filling of the reservoir 10, and a closed position shown in FIG. 1, for closing the aperture 27. In moving to the closed position, the lower end of the cylindrical side wall 92 snaps past the edge of the aperture 27, which edge seats in the groove 93, with the peripheral flange disposed in the aperture 27. The forward end of the rim 93 provides a tab 94 to facilitate lifting the button 90 to its open position. In an alternate embodiment, the aperture 27 may have a rigid ring mounted therein and the ring is formed to allow the button 90 to be snapped to the ring. In an embodiment, the button 90 includes a rigid outer diameter portion to engage the ring.

In operation, when it is desired to open the valve assembly 70, the flexible and resilient dome 91 of the button 90 is depressed by the thumb of a user's hand wrapped around the handle grip sleeve 35. The parts are dimensioned and oriented so that the size of the button 90, distance from the valve 70, volume of the reservoir 10 and construction of the valve itself provide for a predetermined amount of fluid to be dispensed through the valve upon each complete deflection of the button 90. Upon deflection of the button 90, the pressure within the reservoir 10 is increased, the fluid is forced against the valve 70 and the valve is pushed open. When the valve is opened, fluid stored in the reservoir 10 may pass through the passage defined by the apertures 48 and 63 to the bristles 59.

In an embodiment, the orientation of these components may provide for precise volumes of fluid, such as clumps of liquid soap, to be dispensed. By altering the orientation of these components the apparatus 20 may be constructed to be customized for specific applications or cleaning jobs that require a specified amount of fluid dispensed. For example, an apparatus 20 that has a bristle block head that is to be used for scrubbing pans that have debris baked onto the pan surfaces may require extra large volumes of soap to be dispensed. For such an application, a high volume orientation of the fluid dispensing components may be provided. In such an embodiment, the button 90 may be formed having a large surface area, the reservoir 10 may have a large volume and the valve assembly 70 may have a large diameter bore and be constructed to deflect easily. Any one or all of these component orientations and sizes may be adjusted to fine tune the volume dispensing capabilities. In a further alternate example, a low volume fluid dispensing orientation may be provided for an apparatus 20 that may have a sponge medium attached to the block 60 and is used for light cleaning tasks. In such an embodiment, a button 90 having a small surface area, a small volume reservoir and a valve 70 with a small bore and restrained deflection may be provided in the construction of the apparatus 20.

In assembly, the button hinge 95 is seated in place with its leg 96 in the handle recess 32, and then the grip sleeve 35 is installed over the handle 30 to lock the hinge 95 in place. The valve assembly 70 is then assembled on the end plate 40, by mounting the valve 75 within bore 73 to the retaining ring 71. The retaining ring 71 is then mounted within aperture 48 of the plate 40. The end plate 40 is then fitted to the body 22, and in an embodiment ultra sonically welded thereto. The block 60 is then slid onto the plate 40 so that the first coupling structure 43–47 mates with the second coupling structure 51–54 and 61–67. In this regard, all of the parts of the apparatus 20, are preferably formed of suitable moldable polymer materials compatible with liquid soap. Although the grip sleeve 35 may be formed of a suitable elastomeric material, the valve 75 may be formed of a rubber-like material, and the button 90 may be formed of a rubber material or a polymer material such as Tresfin. However, in alternate embodiments other materials such as metals or ceramics may be used for the above described components.

In the preferred embodiment, the apparatus 20 has a work-engaging medium in the form of bristles 59 fixed in a bristle block 60 which serves as a holder. However, it will be appreciated that the principles of the invention are applicable to other types of utensils wherein the work-engaging medium takes other forms, such as sponges, pads or the like, in which case the bristle block 60 would be modified to a suitable type of holder for that medium. Furthermore, the principles of the invention are not limited to household utensils, but rather, the fluid-dispensing aspects of the invention are applicable to other types of implements, apparatuses and utensils.

For example, referring to FIGS. 4 and 5 there is illustrated an alternate arrangement of block 60*a*. More specifically, there is shown a block 60*a* which is substantially the same as the bristle block 60, described above, wherefore like parts bear the same reference numbers for the apparatus 20 as described above. The block 60*a* differs from the bristle block 60 in that it includes a sponge medium 59*a*. The sponge 59*a* includes aperture 63*a* that is aligned with aperture 48 of the plate 40, so that fluid, such as liquid soap may be dispensed therein and absorbed by the sponge 59*a*. In an alternate embodiment, multiple apertures may be provided or other means such as tubes provided to help disperse the fluid across the entire area of the sponge 59*a* or other cleaning medium provided on the block 60.

From the foregoing, it can be seen that there has been provided an improved fluid-dispensing implement which is of simple and economical construction and is characterized by ease of assembly and operation.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A fluid-dispensing apparatus comprising:

a housing defining a fluid reservoir therein;

a first coupling structure on the housing;

a holder having a second coupling structure and a latch arm disposed adjacent the second coupling structure, the holder having a recess providing the second coupling structure and having an open end and an opposite closed end and the latch arm including a tab protruding beyond the open end and a latch lever extending along a bottom of the recess from the open end of the recess toward the closed end, the latch arm for latching engagement with the housing for securely mounting the holder on the housing when the first coupling structure is coupled to the second coupling structure;

a work-engaging medium carried by the holder; and a valve carried by the housing and cooperating with the holder to provide communication between the reservoir and the medium.

2. The apparatus of claim 1, further comprising an end wall of the housing attached to the first coupling structure and the latch arm includes a latch surface that engages the end wall and the first coupling structure includes a wedge-shaped projection.

3. The apparatus of claim 2, wherein the second coupling structure includes a wedge-shaped recess and the projection and the recess respectively have mating dovetail shapes in transverse cross section.

4. The apparatus of claim 2, wherein the holder includes a resilient spring finger for biasing against the wedge shaped projection of the housing.

5. The apparatus of claim 2, wherein the projection is formed on a plate carried by the housing.

6. The apparatus of claim 5 wherein the plate is welded to an end of the housing.

7. The apparatus of claim 1, wherein the tab is depressible by a user's thumb or finger to release the latch arm from engagement with the housing.

8. The apparatus of claim 7, wherein the latch arm includes a proximate end attached to a bottom portion of a recess of the holder.

9. The apparatus of claim 1, wherein the housing includes a resilient button having a bias member.

10. The apparatus of claim 9, wherein the bias member is a rib running along the interior of the button.

11. The apparatus of claim 1, wherein the apparatus is a kitchen brush and the work-engaging medium is a plurality of bristles.

12. A fluid-dispensing apparatus comprising:

a body defining a fluid reservoir therein;

a handle carried by the body;

a work-engaging medium carried by the body;

a valve assembly carried by the body for providing communication between the reservoir and the medium; and a flexible and resilient button mounted on the body for movement between a rest position and depressed position, the button including a bias member having a pair of ribs disposed along an interior of the button and being manually deflectable to the depressed position to increase pressure within the fluid reservoir to activate the valve assembly and one of the button, valve and reservoir being alterable in size or orientation to provide a variable volume orientation of fluid dispensing so that a predetermined volume of fluid is dispensed by the apparatus, wherein the button includes a flexible and resilient dome portion, the dome portion including a nipple protruding into the interior and being depressible by a user's thumb or finger to move the button to the depressed position, and wherein each rib has a generally triangular shape and is attached to the nipple to bias the dome to return the dome to its rest position.

13. A fluid-dispensing apparatus comprising:

a handle having a reservoir for receiving fluid;

a button mounted on the handle the button having a predetermined surface area and defining an interior;

a rib attached to a wall of the interior of the button;

a resilient member carried by the button, the resilient member including a center nipple having a pair of ribs extending therefrom and providing an increase in pressure in the reservoir when the resilient member is depressed, a block attached to the handle having a cleaning medium;

a valve disposed on the handle for dispensing fluid therethrough when the resilient member is depressed, the valve having a predetermined deflection operation and the predetermined surface area and deflection operation being coordinated to provide a predetermined volume of fluid to be dispensed from the apparatus; and one of the button, valve and reservoir being alterable in size or orientation to provide for dispensing of the predetermined volume of fluid.

* * * * *